US007692519B2

(12) United States Patent
Premerlani et al.

(10) Patent No.: US 7,692,519 B2
(45) Date of Patent: Apr. 6, 2010

(54) MEMS SWITCH WITH IMPROVED STANDOFF VOLTAGE CONTROL

(75) Inventors: William James Premerlani, Scotia, NY (US); Christopher Fred Keimel, Schenectady, NY (US); Kanakasabapathi Subramanian, Clifton Park, NY (US); Xuefeng Wang, Schenectady, NY (US); Marco Francesco Aimi, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 152 days.

(21) Appl. No.: 11/962,178

(22) Filed: Dec. 21, 2007

(65) Prior Publication Data

US 2009/0160584 A1 Jun. 25, 2009

(51) Int. Cl.
*H01P 1/10* (2006.01)
*H01H 57/00* (2006.01)

(52) U.S. Cl. ..... 333/262; 333/105

(58) Field of Classification Search ..... 333/101, 333/103, 104, 105, 262
See application file for complete search history.

(56) References Cited

U.S. PATENT DOCUMENTS 5,619,061 A * 4/1997 Goldsmith et al. ..... 257/528

* cited by examiner

*Primary Examiner*—Dean O Takaoka
(74) *Attorney, Agent, or Firm*—Richard D. Emery

(57) ABSTRACT

A MEMS switch is provided including a substrate, a movable actuator coupled to the substrate and having a first side and a second side, a first fixed electrode coupled to the substrate and positioned on the first side of the movable actuator to generate a first actuation force to pull the movable actuator toward a conduction state, and a second fixed electrode coupled to the substrate and positioned on the second side of the movable actuator to generate a second actuation force to pull the movable actuator toward a non-conducting state.

20 Claims, 8 Drawing Sheets

MEMS SWITCH WITH IMPROVED STANDOFF VOLTAGE CONTROL

BACKGROUND

Embodiments of the invention relate generally to a microelectromechanical system (MEMS) switch.

Microelectromechanical systems (MEMS) generally refer to micron-scale structures that can integrate a multiplicity of functionally distinct elements such as mechanical elements, electromechanical elements, sensors, actuators, and electronics, on a common substrate through micro-fabrication technology. MEMS generally range in size from a micrometer to a millimeter in a miniature sealed package. A MEMS switch has a movable actuator that is moved toward a stationary electrical contact by the influence of a gate or electrode positioned on a substrate.

FIG. 1 illustrates a conventional MEMS switch in an open or non-conducting state according to the prior art. The MEMS switch 10 includes a substrate 18, a movable actuator 12, a contact 16 and control electrode 14 mechanically coupled to the substrate 18. In operation, the movable actuator 12 is moved toward the contact 16 by the influence of a control electrode 14 (also referred to as a gate or gate driver) positioned on the substrate 18 below the movable actuator 12. The movable actuator 12 may be a flexible beam that bends under applied forces such as electrostatic attraction, magnetic attraction and repulsion, or thermally induced differential expansion, that closes a gap between a free end of the beam and the stationary contact 16. The movable actuator 12 is normally held apart from the stationary contact 16 in the de-energized state through the spring stiffness of the movable electrode. However, if a large enough voltage is provided across the stationary contact 16 and the movable electrode 12, a resulting electrostatic force can cause the movable electrode 12 to self-actuate without any gating signal being provided by control electrode 14.

Power system applications of MEMS switches are beginning to emerge, such as replacements for fuses, contactors, and breakers. One of the important design considerations in constructing a power switching device with a given overall voltage and current rating is the underlying voltage and current rating of the individual switches used in the array of switches that comprise the device. In particular, the voltage that the individual switches can withstand across their power contacts is an important parameter. There are several factors and effects that determine the voltage rating of an individual MEMS switch. One such factor is the self-actuation voltage.

In a MEMS switch, the self-actuation voltage is an effect that places an upper bound on the voltage capability of the switch. Electrostatic forces between the line and load contacts (e.g. between the movable actuator and stationary contact) will cause the movable actuator to self-actuate or make contact with the stationary contact when the voltage between across the actuator and contact exceeds a certain threshold. In certain current switching applications, this self-actuation can result in catastrophic failure of the switch or downstream systems.

BRIEF DESCRIPTION

In one embodiment, a MEMS switch is provided including a substrate, a movable actuator coupled to the substrate and having a first side and a second side, a first fixed electrode coupled to the substrate and positioned on the first side of the movable actuator to generate a first actuation force to pull the movable actuator toward a conduction state, and a second fixed electrode coupled to the substrate and positioned on the second side of the movable actuator to generate a second actuation force to pull the movable actuator toward a non-conducting state.

In another embodiment, a method of fabricating a MEMS switch is provided. The method includes forming a first fixed control electrode and a fixed contact on an insulating layer on a substrate, forming a movable actuator on the insulating layer such that the movable actuator overhangs the first fixed control electrode and the contact and forming a second fixed control electrode on the insulating layer and overhanging the movable actuator. The method further includes releasing the movable actuator to allow the actuator to be pulled toward a first conduction state with the contact in response to a first actuation force generated between the first fixed control electrode and the movable actuator, and a second non-conducting state in response to a second actuation force generated between the second fixed control electrode and the movable actuator.

In a further embodiment, a MEMS switch array is provided. The MEMS switch array includes a substrate, a first movable actuator coupled to the substrate and having a top side and a bottom side, and a second movable actuator coupled to the substrate and having a top side and a bottom side. The MEMS array further includes a first fixed control electrode coupled to the substrate and positioned on the bottom side of the first and second movable actuators to generate a first actuation force to pull the movable actuators toward a conduction state, and a second fixed control electrode coupled to the substrate and positioned on the top side of the first and second movable actuators to generate a second actuation force to pull the movable actuators toward a non-conducting state.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

In the following detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. In other instances, well known methods, procedures, and components have not been described in detail.

Furthermore, various operations may be described as multiple discrete steps performed in a manner that is helpful for understanding embodiments of the present invention. However, the order of description should not be construed as to imply that these operations need be performed in the order they are presented, nor that they are even order dependent. Moreover, repeated usage of the phrase "in one embodiment" does not necessarily refer to the same embodiment, although it may. Lastly, the terms "comprising", "including", "having", and the like, as well as their inflected forms as used in the present application, are intended to be synonymous unless otherwise indicated.

Figure 1:
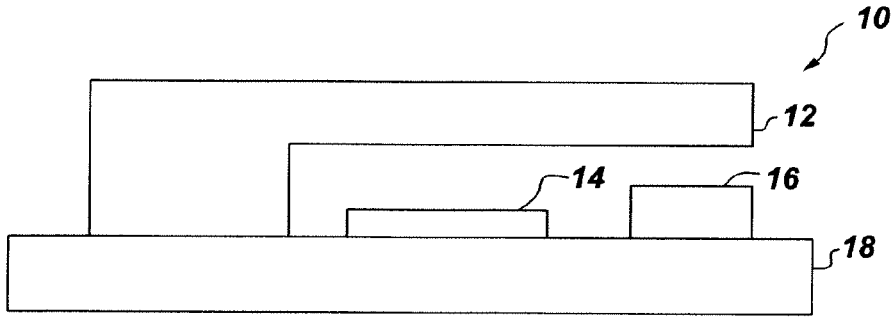
Fig. 1 Prior Art
FIG. 1 illustrates a conventional MEMS switch in an open or non-conducting state according to the prior art.
Figure 2:
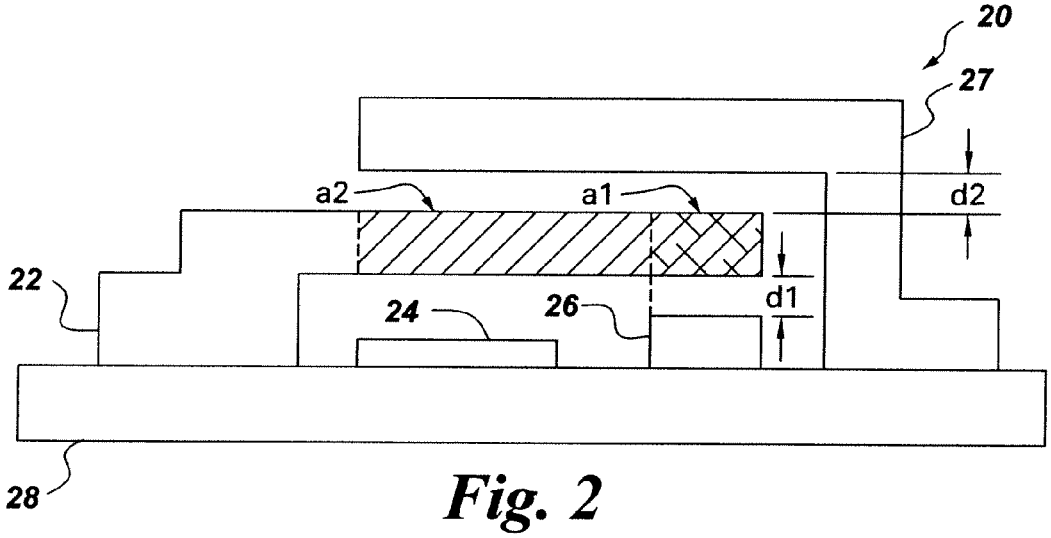
FIG. 2 is a schematic diagram illustrating one embodiment of a MEMS switch having improved standoff voltage control.

FIG. 2 is a schematic diagram illustrating one embodiment of a MEMS switch having improved standoff voltage control. Although the term "MEMS" commonly refers to micron-scale structures, embodiments of the present invention described throughout this document should not be limited to sub-micron scale devices unless otherwise indicated. In the illustrated embodiment, MEMS switch 20 includes a movable actuator 22 mechanically coupled to a substrate 28. In one embodiment, the movable actuator 22 is fully or partially conductive. The substrate 28 may be conductive, semi-conductive or insulating. In an embodiment where the substrate 28 is conductive, the substrate may be coated with an insulating or electrical isolation layer (not illustrated) to prevent undesirable shorting between and amongst switch contacts/electrodes and the movable actuator. Non-limiting examples of conducting substrates include those formed from silicon and germanium, whereas non-limiting examples of an electrical isolation layer include silicon nitride, silicon oxide, and aluminum oxide.

MEMS switch 20 further includes a first electrode 24 (also referred to as a gate or control electrode) and a contact 26. In one embodiment, an electrostatic force may be generated between the first electrode 24 and the movable actuator 22 upon application of a voltage differential between the two components. Thus, upon actuation, the movable actuator 22 is attracted towards the first electrode 24 and eventually makes electrical contact with contact 26. However, as was previously described, in high voltage applications, conventional MEMS switches are prone to self-actuating even when there is no signal applied to the first electrode 24. In accordance with one aspect of the present invention, a second electrode (also referred to as a counter electrode) 27 is provided to generate a second actuation force opposing the self-actuation force such that the movable actuator is pulled toward a non-conducting state away from the contact 26.

In one embodiment, the second electrode 27 is coupled to the same substrate 28 as the moveable actuator 22 and is positioned over (e.g., on the side parallel to and opposite the substrate 28) the moveable actuator 22 and at least partially over contact 26. By fabricating the counter electrode 27 on the same substrate as the movable actuator 22, variations in electrode spacing between the movable actuator 22 and the counter electrode 27 can be eliminated through tightly controlled photolithographic processes.

The electrostatic force present between the substrate contact 26 and the movable actuator 22 can be approximately computed as the force across a capacitor's plates as illustrated by Eqn. (1), where the plate area is the common area of overlap of the two electrodes:

$$F_{electrostatic} = \varepsilon_0 \cdot A \cdot \frac{V^2}{g^2} \qquad \text{Eqn. (1)}$$

$F_{electrostatic}$ = electrostatic attraction force, newtons $\varepsilon_0 = 8.85 \cdot 10^{-12}$ farads/meter $A$ = overlap area, meter$^2$ $V$ = voltage across the gap, volts $g$ = contact gap, meters Thus, as the voltage differential across the gap between the contact 26 and the movable actuator 22 increases, or as the overlap area (a1) increases, or as the gap (d1) decreases, the larger the resulting electrostatic force will become. Similarly, as the voltage differential across the gap between the electrode 27 and the movable actuator 22 increases, or as the overlap area (a2) increases, or as the gap (d2) decreases, the larger the resulting electrostatic force will become. Accordingly, the counter electrode 27 may be designed based upon the desired standoff voltage. In one embodiment, the distance d2 is greater than d1. In one embodiment, a2 is greater than a1.

In one embodiment, the voltage level between the first electrode 24 and the movable actuator 22 is separately controlled from the voltage level between the movable actuator 22 and the counter electrode 27. In one embodiment, when it is desirable to maintain the switch in a non-conduction (e.g., open) state, the applied voltage between the first electrode 24 and the movable actuator 22 can be set to zero or another relatively low value, while the applied voltage between the counter electrode 27 and the movable actuator 22 can be set to a relatively higher value. When it is desirable to maintain the switch in a conducting (e.g., closed) state, the applied voltage between the first electrode 24 and the movable actuator 22 can be set to a relatively high value, while the applied voltage between the counter electrode 27 and the movable actuator 22 can be set to zero or a relatively lower value.

In another embodiment, the counter electrode 27 may be electrically coupled to the contact 26 such that whatever voltage happens to exist between the contact 26 and the movable actuator 22 will also appear between the movable actuator 22 and the counter electrode 27. By appropriately selecting the size of the counter electrode 27 as well as the spacing between the counter electrode 27 and the movable actuator 22, the self-actuating force generated between the contact 26 and the movable actuator 22 can be balanced with the counter actuation force generated between the movable actuator 22 and the counter electrode 27.

As used herein, the term "above" is intended to refer to a location that is farther away from the substrate 28 than the referenced object, while the term "below" is intended to refer to a location that closer to the substrate 28 than the referenced object. For example, if an item is "above" the movable actuator 22, then the item is farther away from the substrate 28 than the referenced movable actuator 22. In one embodiment, the MEMS switch 20 may include an isolator (not illustrated) positioned above the movable actuator 22 to prevent the movable actuator from making contact with the counter electrode 27. In one embodiment, the isolator may be fabricated as part of counter electrode 27 or as a separate component. The isolator may be formed from a material having insulating, highly resistive or dielectric properties. Further, the isolator may take the form of a rigid or semi-rigid post or pillar, or the isolator may be deposited on the counter electrode as a coating. Moreover, the isolator may be fabricated on either the underside (e.g., on the same side as the substrate 28) of the counter electrode 27 or on the top side (e.g., on the side farther away from the substrate 28) of the movable actuator 22. In one embodiment, while in a non-conducting state, the movable actuator 22 may be positioned in physical contact with the counter electrode 27 while remaining electrically isolated from the counter electrode 27. In another embodiment, while in a non-conducting state the movable actuator 22 may be attracted towards the counter electrode 27 but remain mechanically and electrically isolated from the counter electrode 27. In such a non-conducting state, the movable actuator 22 may remain in a stationary position.

Figure 3:
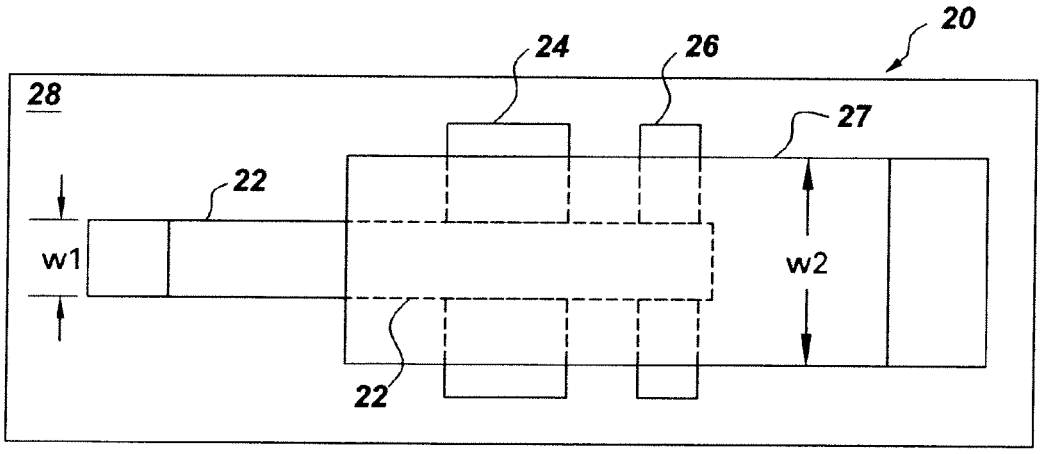
FIG. 3 is a schematic diagram illustrating a top view of MEMS switch 20 of FIG. 2.

FIG. 3 is a schematic diagram illustrating a top view of MEMS switch 20 of FIG. 2. As can be seen by FIG. 3, the counter electrode 27 is arranged in parallel with the movable actuator 22. As previously mentioned, the area of the overlap between the counter electrode 27 and the movable actuator 22 can be designed based upon the electrostatic force that is desirable between the two components. For example, as illustrated in FIG. 3, the width (w2) of the counter electrode 27 may be designed to be greater or less than the width (w1) of the movable actuator 22.

Figure 4:
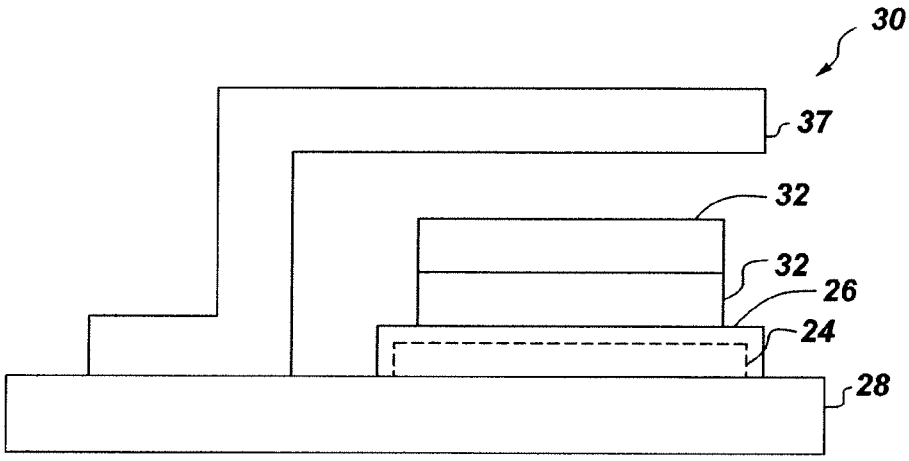
FIG. 4 and FIG. 5 are schematic diagrams respectively illustrating side and top views of a MEMS switch 30 according to an alternative embodiment of the invention.
Figure 5:
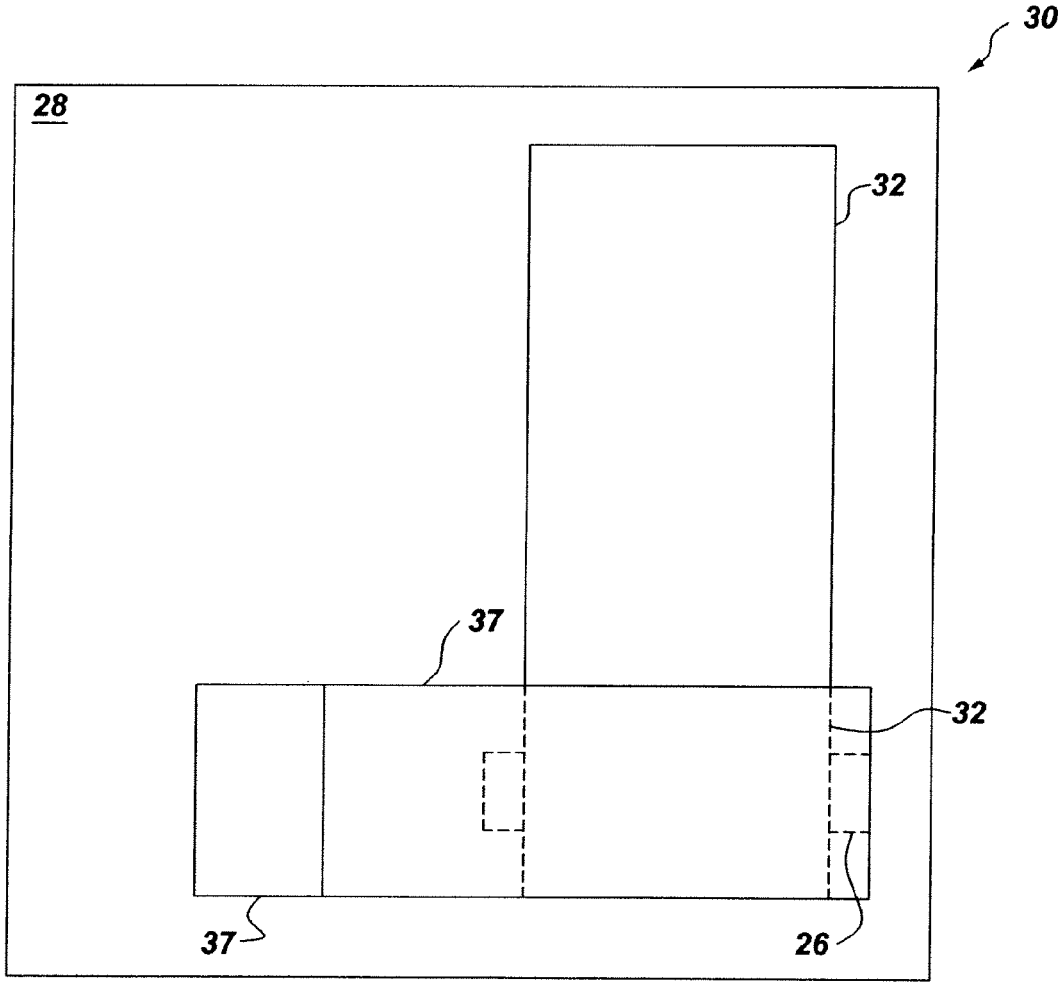

FIG. 4 and FIG. 5 are schematic diagrams respectively illustrating side and top views of a MEMS switch 30 according to an alternative embodiment of the invention. The MEMS switch 30 is substantially similar to the MEMS switch 20 of FIG. 2 and FIG. 3. In particular, a counter electrode 37 is provided that is coupled to the same substrate 28 as the movable actuator 22. However, in the illustrated embodiment of FIG. 4 and FIG. 5, the counter electrode 37 is positioned above the movable actuator 22 substantially opposite the contact 26 in an orthogonal relationship to the movable actuator 32.

Figure 6:
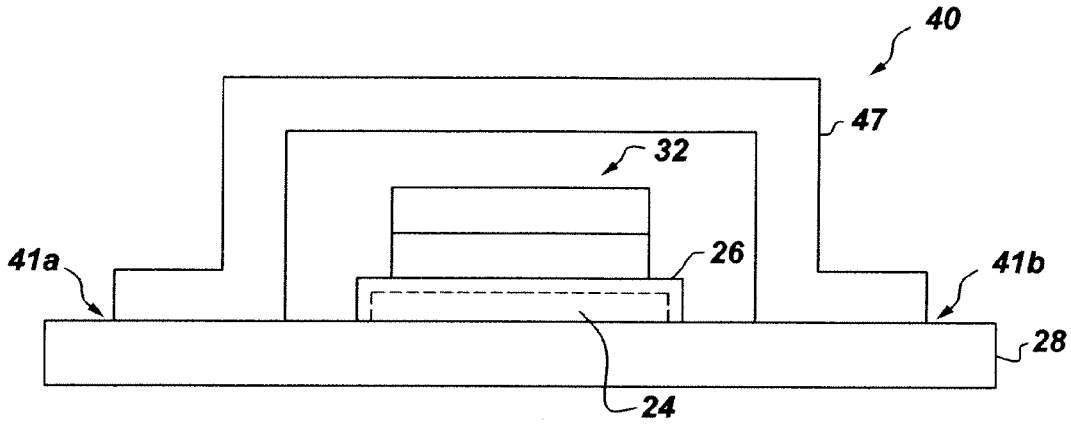
FIG. 6 is a schematic diagram illustrating a MEMS switch 40 in accordance with a further embodiment of the invention.

FIG. 6 is a schematic diagram illustrating a MEMS switch 40 in accordance with a further embodiment of the invention. As illustrated, MEMS switch 40 is substantially similar to MEMS switch 30 and includes a movable actuator 32, an electrode 24 and a contact 26 all coupled to a substrate 28. However, in FIG. 6, the counter electrode 47 is coupled to the substrate 28 at least two locations (41*a*, 41*b*).

Figure 7:
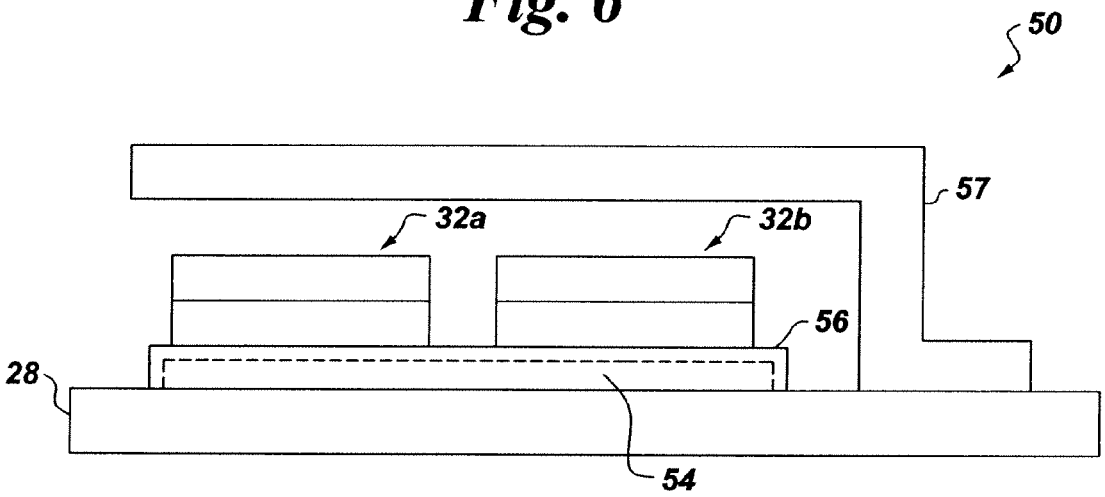
FIG. 7 is a schematic diagram illustrating a MEMS switch 50 in accordance with yet another embodiment of the invention.

FIG. 7 is a schematic diagram illustrating a MEMS switch 50 in accordance with yet another embodiment of the invention. MEMS switch 50 is substantially similar to MEMS switch 30, however MEMS switch 50 includes a counter electrode 57 that overlaps at least two movable actuators 32. The movable actuators 32 may be electrically isolated or coupled in a series, or parallel, or series-parallel arrangement. In the illustrated embodiment, the movable actuators 32 are shown as sharing a common load contact 56 and a common gate driver (e.g., electrode 54). However, the movable actuators 32 may instead be separately actuated and the movable actuators 32 may electrically couple separate load circuits.

Figure 8:
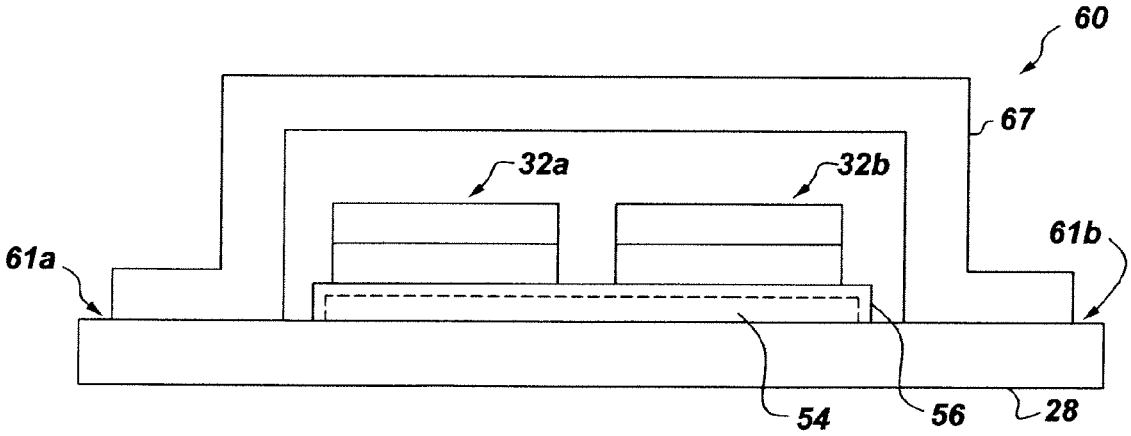
FIG. 8 is a schematic diagram illustrating a MEMS switch 60 in accordance with another embodiment of the invention.

FIG. 8 is a schematic diagram illustrating a MEMS switch 60 in accordance with yet another embodiment of the invention. As illustrated, MEMS switch 60 is substantially similar to MEMS switch 40 in that the counter electrode 67 is coupled to the substrate 28 at least two locations (61*a*, 61*b*). However, in addition, the counter electrode 67 of FIG. 8 overlaps at least two movable actuators 32. As with MEMS switch 50 of FIG. 7, the movable actuators 32 may be electrically isolated or coupled in a series, or parallel, or series-parallel arrangement. In the illustrated embodiment, the movable actuators 32 are shown as sharing a common load contact 56 and a common gate driver (e.g., electrode 54). However, the movable actuators 32 may instead be separately actuated and the movable actuators 32 may electrically couple separate load circuits.

FIGS. 9-30 illustrate an example fabrication process for fabricating a MEMS switch 70 having improved standoff voltage control in accordance with embodiments of the invention. Although the MEMS switch 70 appears similar in form to MEMS switch 20 of FIG. 2 and FIG. 3, the following fabrication process may be adapted to fabricate any of the previously described MEMS switches having improved standoff voltage control. Furthermore, although an example fabrication process is described herein, it is contemplated that variations in the process may be implemented without departing from the spirit and scope of the invention.

Figure 9:
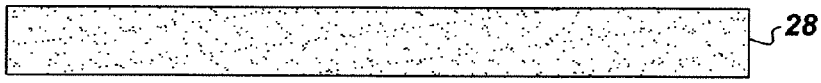
FIGS. 9-30 illustrate an example fabrication process for fabricating a MEMS switch 70 having improved standoff voltage control in accordance with embodiments of the invention.
Figure 10:
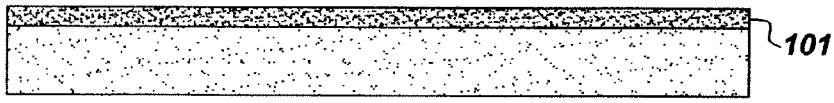
Figure 11:
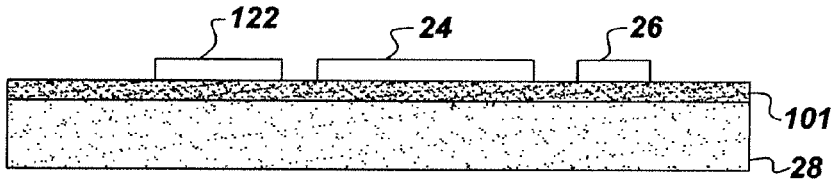
Figure 12:
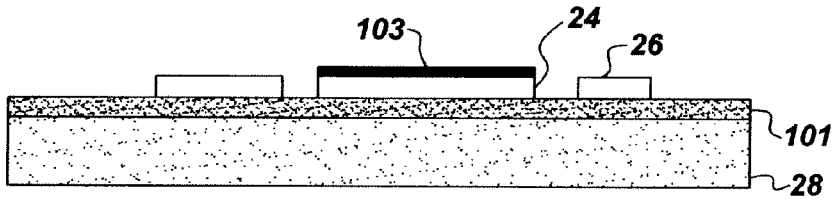

In FIG. 9, a substrate 28 is provided. In one embodiment the substrate comprises silicon. In FIG. 10 an electrical isolation layer 101 may be deposited on the substrate 28 using chemical vapor deposition or thermal oxidation methods. In one embodiment, the electrical isolation layer 101 includes Si3N4. In FIG. 11, conductive electrodes are deposited and patterned on to the electrical isolation layer 101. More specifically, a contact 26, a control electrode 24 and an anchor contact 122 are formed. In one embodiment, a contact 26, a control electrode 24 and an anchor contact 122 comprise a conductive material such as gold and may be formed from the same mask. It should be noted that the anchor contact 122 could be formed as part of the movable actuator (to be described), however fabrication can be simplified through the addition of the anchor contact 122. In FIG. 12, an insulation layer 103 is deposited on the control electrode 24 in order to prevent shorting between the movable actuator and the control electrode 24. In one embodiment, the insulation layer 103 may be formed from SiN4, however other insulating, or highly resistive coatings may be used. In another embodiment, the insulation layer can be formed on the underside of the movable electrode. Alternatively, a mechanical post may be fabricated between the control electrode 24 and the contact 26 to prevent the movable actuator from contacting the control electrode 24. In such a case, the insulation layer 103 may not be needed.

Figure 13:
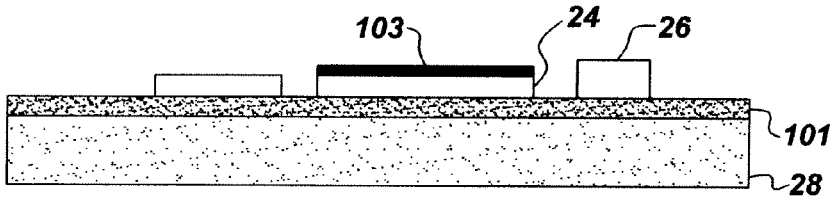
Figure 14:
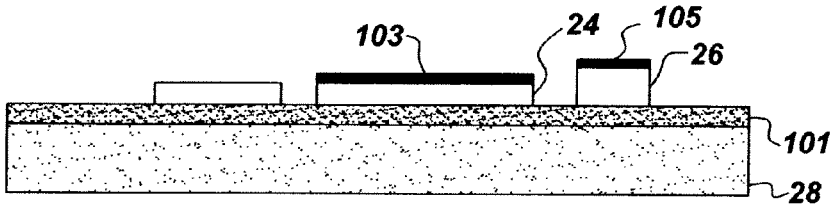

FIG. 13 and FIG. 14 illustrate two processing steps that may be omitted completely depending upon which features are desired for the MEMS switch 70. More specifically, FIG. 13 illustrates additional conductive material being deposited on contact 26 to make the contact taller. This may be useful to decrease the distance that the movable actuator needs to travel and to further prevent the movable actuator from contacting the control electrode 24. However, it should be noted that the closer the contact 26 is to the movable electrode, the greater the resulting electrostatic force will be between the two components as shown by Eqn. 1. In FIG. 14, an additional contact material 105 is deposited on the contact 26. The contact material may be used to enhance conduction between the contact 26 and the movable actuator while prolonging life of the switch.

Figure 15:
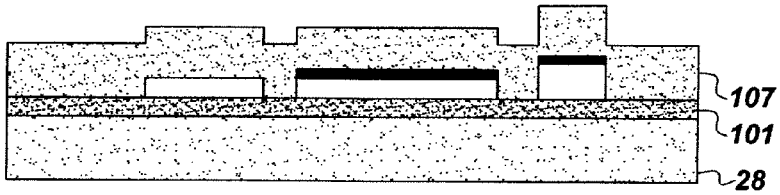
Figure 16:
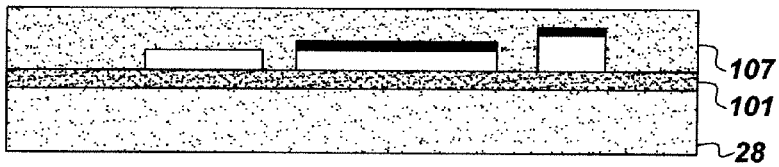
Figure 17:
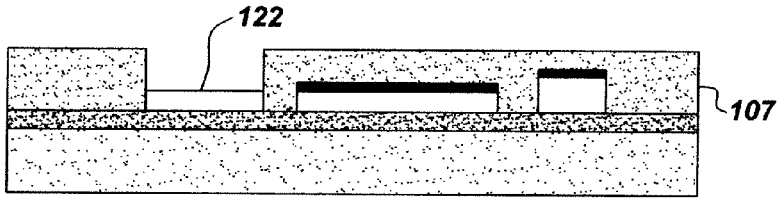
Figure 18:
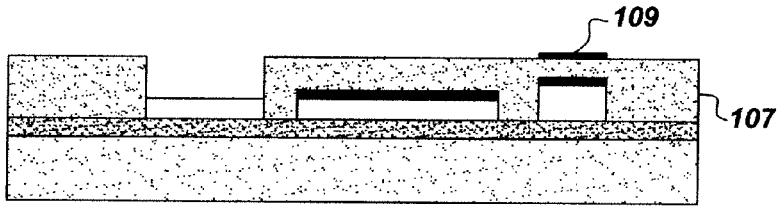

In FIG. 15, a sacrificial layer 107 is deposited on top of the contact 26, the control electrode 24 and the anchor contact 122. In one embodiment, the sacrificial layer 107 may be SiO2. FIG. 16 illustrates an optional polishing step where the sacrificial layer is polished by, for example, chemical-mechanical polishing. In FIG. 17 the sacrificial layer 107 is etched to expose the anchor contact 122. In the event it is desirable to add a contact material layer on movable actuator, an additional contact 109 may be patterned as illustrated in FIG. 18.

Figure 19:
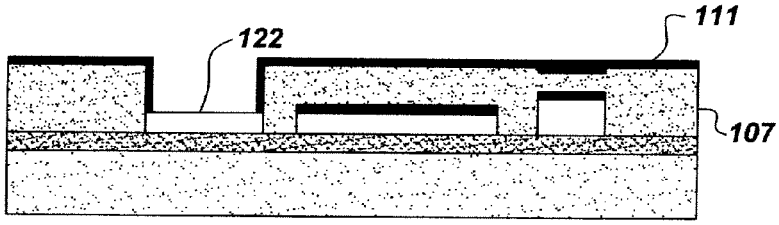
Figure 20:
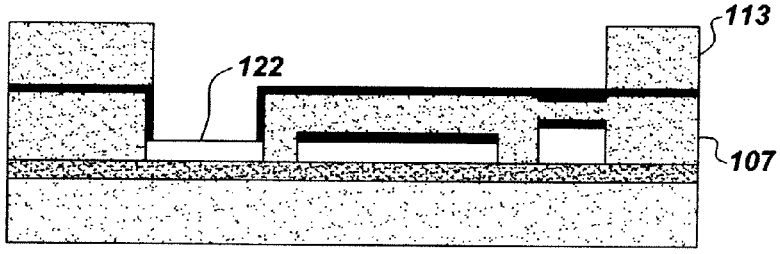
Figure 21:
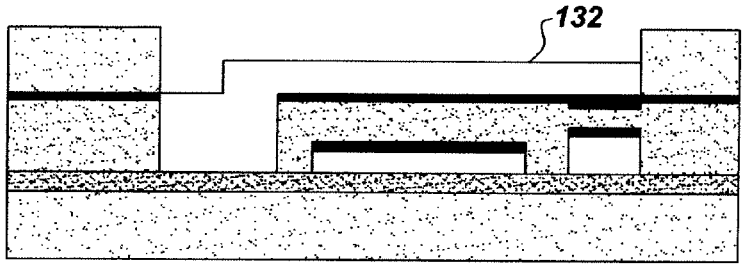
Figure 22:
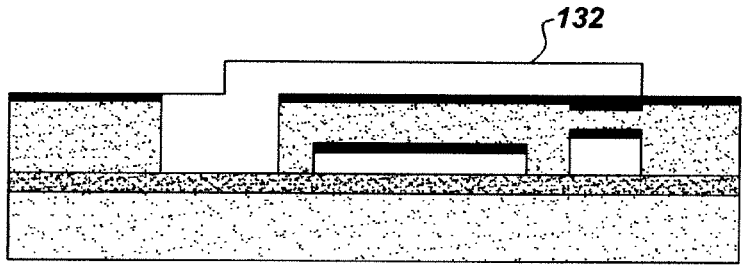
Figure 23:
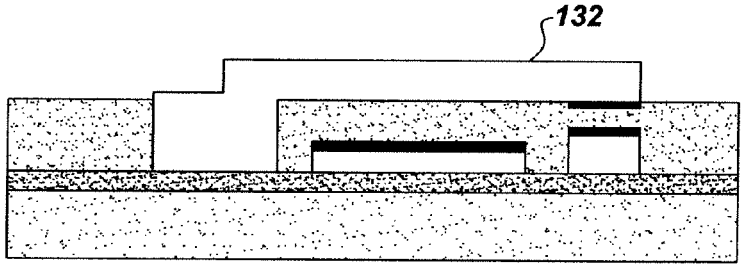

FIGS. 19-23 illustrate the formation of a movable actuator 132. In one embodiment, the movable actuator 132 is formed through an electroplating process. In FIG. 19, a seed layer 111 is provided for the electroplating process. In FIG. 20 a mold 113 is patterned for electroplating the movable actuator 132, which is shown in FIG. 21. In FIG. 22 and FIG. 23, the electroplating mold 113 and the seed layer 111 are removed.

Figure 24:
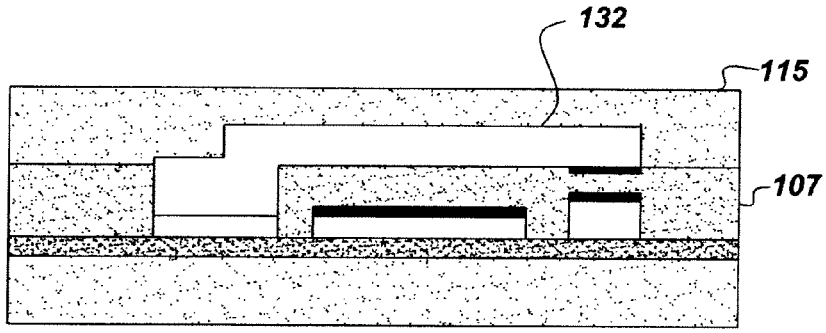
Figure 25:
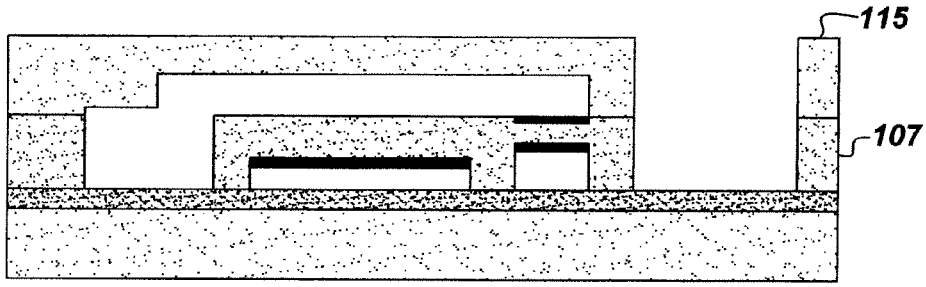
Figure 26:
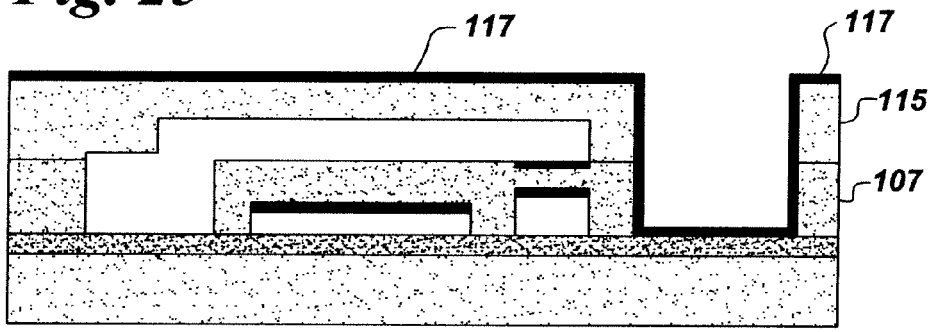
Figure 27:
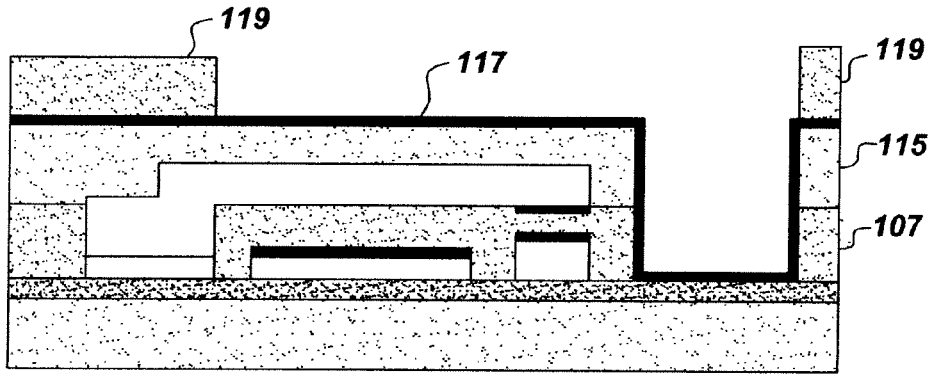
Figure 28:
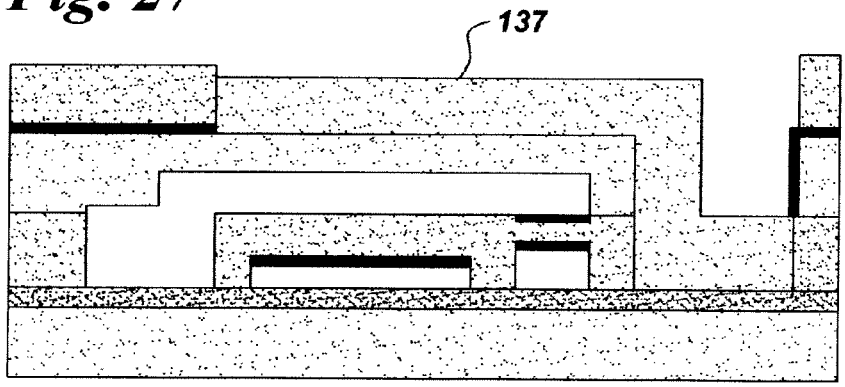
Figure 29:
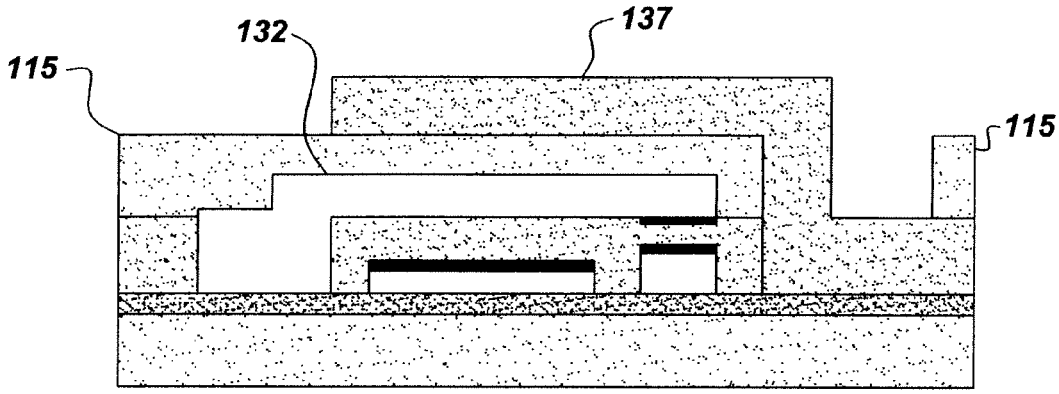
Figure 30:
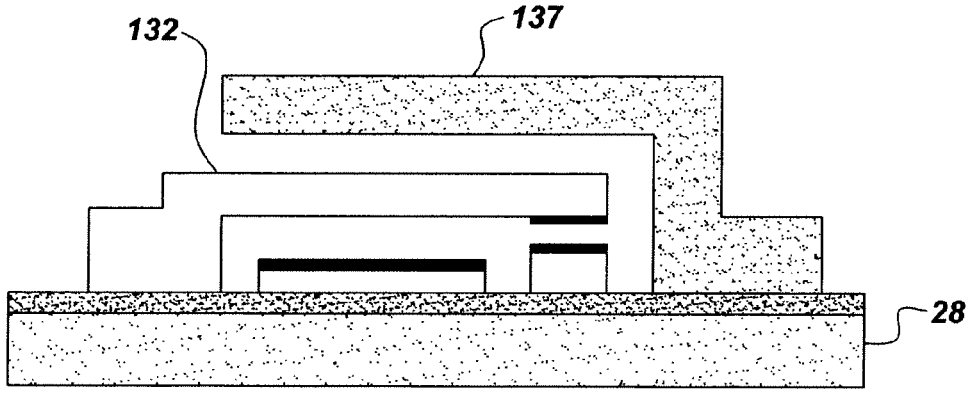

Once the movable actuator 132 has been formed, a counter electrode 137 as described herein may be formed. As part of the counter electrode process, a second sacrificial layer 115 may be deposited and optionally polished as illustrated in FIG. 24. In one embodiment, the second sacrificial layer may comprise SiO2. In FIG. 25, both sacrificial layer 115 and sacrificial layer 107 are etched in the location where the counter electrode 137 will be formed as shown. An electroplating seed layer 117 and an electroplating mold 119 are then formed as illustrated in FIG. 26 and FIG. 27, respectively. In FIG. 28 the counter electrode 137 is electroplated. In one embodiment, the counter electrode 137 is formed from a conductive material such as gold. In FIG. 29 and FIG. 30, the electroplating mold 119 and seed layer 117 are removed, and in FIG. 30 the sacrificial layer 115 is removed to free the counter electrode.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A device comprising:

a substrate;

a movable actuator coupled to the substrate and having a first side and a second side, the moveable actuator being configured such that a stiffness of the movable actuator causes the movable actuator to move from a conduction state to a non-conducting state in the absence of external forces;

a first fixed electrode coupled to the substrate and positioned on the first side of the movable actuator to generate a first actuation force to pull the movable actuator toward the conduction state; and a second fixed electrode coupled to the substrate and positioned on the second side of the movable actuator to generate a second actuation force to pull the movable actuator toward the non-conducting state.

2. The device of claim 1, wherein second fixed electrode is positioned above the first fixed electrode.

3. The device of claim 2, wherein second fixed electrode is coupled to the substrate at least two locations.

4. The device of claim 1, wherein the movable actuator is stationary in the non-conducting state.

5. The device of claim 1, wherein the second fixed control electrode is positioned over the movable actuator and is coupled to the substrate at more than one location on the substrate.

6. The device of claim 1, further comprising an isolator positioned above the movable actuator to prevent the movable actuator from making contact with the second fixed control electrode.

7. The device of claim 1, further comprising a fixed contact mechanically coupled to the substrate and electrically coupled to a load circuit.

8. The device of claim 7, wherein the second actuation force is greater than the first actuation force.

9. The device of claim 7, wherein the movable actuator is separated from the first fixed electrode by a first distance and the movable actuator is separated from the second electrode by a second distance.

10. The device of claim 9, wherein the first distance is greater than the second distance.

11. The device of claim 7, wherein the movable actuator overlaps the first fixed electrode by a first area and the movable actuator overlaps the second electrode by a second area.

12. The device of claim 7, wherein the second area is greater than the first area.

13. The device of claim 7, wherein the fixed contact and the second fixed control electrodes are electrically coupled.

14. The device of claim 13, further comprising an isolator positioned above the movable actuator to prevent the movable actuator from making contact with the second fixed control electrode.

15. The device of claim 14, wherein the movable actuator is conductive.

16. A method comprising:

forming a first fixed control electrode and a fixed contact on an insulating layer on a substrate;

forming a movable actuator on the insulating layer such that the movable actuator overhangs the first fixed control electrode and the contact;

forming a second fixed control electrode on the insulating layer and overhanging the movable actuator; and releasing the movable actuator to allow the actuator to be pulled toward a first conduction state with the contact in response to a first actuation force generated between the first fixed control electrode and the movable actuator, to be pulled toward a second non-conducting state in response to a second actuation force generated between the second fixed control electrode and the movable actuator, and to move from the conduction state to the non-conducting state in the absence of external forces due to a stiffness of the movable actuator.

17. The method of claim 16, wherein the movable actuator is stationary in the non-conducting state.

18. The method of claim 16, wherein the second fixed control electrode overhangs the contact.

19. A MEMS switch array comprising:

a substrate;

a first movable actuator coupled to the substrate and having a top side and a bottom side;

a second movable actuator coupled to the substrate and having a top side and a bottom side;

a first fixed control electrode coupled to the substrate and positioned on the bottom side of the first and second movable actuators to generate a first actuation force to pull the movable actuators toward a conduction state; and a second fixed control electrode coupled to the substrate and positioned on the top side of the first and second movable actuators to generate a second actuation force to pull the movable actuators toward a non-conducting state.

20. The MEMS switch array of claim 19, wherein the first and second movable actuators are stationary in the non-conducting state.

* * * * *